US006779315B1

(12) United States Patent
Bongio et al.

(10) Patent No.: US 6,779,315 B1
(45) Date of Patent: Aug. 24, 2004

(54) SUSPENDED CEILING/RAISED FLOOR CONNECTION SYSTEM

(76) Inventors: Vincent J. Bongio, 209 N. Terry Rd., Syracuse, NY (US) 13209-2226; Thomas E. Cavallo, 133 Braintree Dr., Liverpool, NY (US) 13088

( * ) Notice: Subject to any disclaimer, the term of this patent is extended or adjusted under 35 U.S.C. 154(b) by 0 days.

(21) Appl. No.: 10/439,208

(22) Filed: May 15, 2003

(51) Int. Cl.[7] ..... E04B 5/00; E04B 9/00

(52) U.S. Cl. ..... 52/506.07; 52/506.08; 52/655.1

(58) Field of Search ..... 52/506.07, 506.08, 52/653.1, 655.1; 403/230

(56) References Cited

U.S. PATENT DOCUMENTS 3,333,387 A * 8/1967 Deakins ..... 52/664
3,832,816 A * 9/1974 Jahn ..... 52/779
3,837,128 A 9/1974 O'Brien
4,944,129 A * 7/1990 Hartleif ..... 52/506.08
5,076,036 A * 12/1991 Kuiper ..... 52/506.07
5,077,951 A 1/1992 Baker
5,396,748 A 3/1995 Rogers
5,572,844 A 11/1996 Stackenwalt et al.
5,687,527 A 11/1997 Bikard et al.

* cited by examiner

*Primary Examiner*—Lanna Mai
*Assistant Examiner*—Joseph Edell
(74) *Attorney, Agent, or Firm*—August E. Roehrig, Jr.; Hancock & Estabrook, LLP

(57) ABSTRACT

A two-part, upper and lower portion, connector system for coupling together grid-work forming runners and cross members for forming a suspended ceiling or raised floor.

11 Claims, 3 Drawing Sheets

SUSPENDED CEILING/RAISED FLOOR CONNECTION SYSTEM

TECHNICAL FIELD

This invention relates in general to suspended ceilings or raised floor connectors and, in particular, to a connector system to be used for ceilings suspended from an overhead roof or support structure or for use with a platform floor system elevated above a floor base.

BACKGROUND TECHNOLOGY

Suspended ceilings are frequently formed utilizing a channeled grid or framework to suspend the ceiling grid from an existing roof or overhead support structure. In this manner the suspended grid-work is used in combination with ceiling panels to form a suspended ceiling at a height above the floor. Similarly, a platform floor system is formed using a channeled grid or framework, which is supported on a floor base to form a raised floor above the floor base. Floor panels are carried on the framework and the space so formed above the ceiling or below the raised floor can be used for various purposes such as mechanical services for heating, ventilating and air conditioning systems (HVAC) or to form a seal for the space below the suspended ceiling and/or above the raised floor to preserve the integrity of a particular enclosed area such as used in cleanrooms.

These suspended ceiling and raised floor grids are used in combination with panels, which are fitted into the grid-work for forming the suspended ceiling, or raised floor. To this end various configurations of grid-works are utilized. In certain applications, the uppermost portion of the grid-work is formed with a longitudinally extending runner and/or cross member having a substantially U-shaped cross-section to form a channel by which the grid system is connected to a support structure for forming a suspended ceiling from an overhead support or a retainer for receiving and connecting floor panels.

There are many variations of fasteners utilized to secure such grids or framework structures to form a suspended ceiling or raised platform floors. Such systems, however, are frequently difficult or inconvenient to install, while others are designed for use with a specific type of grid or framework system.

Accordingly, the present invention is directed to overcoming one or more of the problems or disadvantages associated with the relevant technology.

SUMMARY OF THE INVENTION

In one embodiment of the present invention, there is provided a two-part, upper and lower portion connector system for coupling together the runners and cross-pieces, or cross members, for a suspended ceiling or raised floor. The lower portion of the connector system comprises a lower connector piece which is adapted to be press-fit into an end of a lower channel of a cross member, and has a portion thereof which is adapted to connect with a lower slot of a runner which is a companion piece to the cross member for forming a ceiling/floor grids system.

The upper portion of the connector system comprises an upper connector piece which is bolted at the end of the cross member in an upper channel thereof, and has an upstanding lip which mates with an inner slot formed adjacent to an upper channel of the companion runner.

In this manner, cross members may be positioned anywhere along the length of a runner by manually inserting the lower connecting piece, secured, in the lower end of the cross member, into the lower slot of the runner and twisting or turning the cross, member to lock the lower connecting piece thereto. The upper connecting piece, carried in the upper end of the cross member, is loosened and the upstanding lip thereof positioned into the adjacent inner slot of the runner. The upper connecting piece is then tightened locking the upper connecting piece to the adjacent runner.

BRIEF DESCRIPTION OF THE DRAWINGS

In the accompanying drawings, like reference numerals indicate corresponding parts throughout, wherein.

Other aspects and features of the present invention can be obtained from a study of the drawings, the disclosure, and the appended claims.

DETAILED DESCRIPTION

Figure 1:
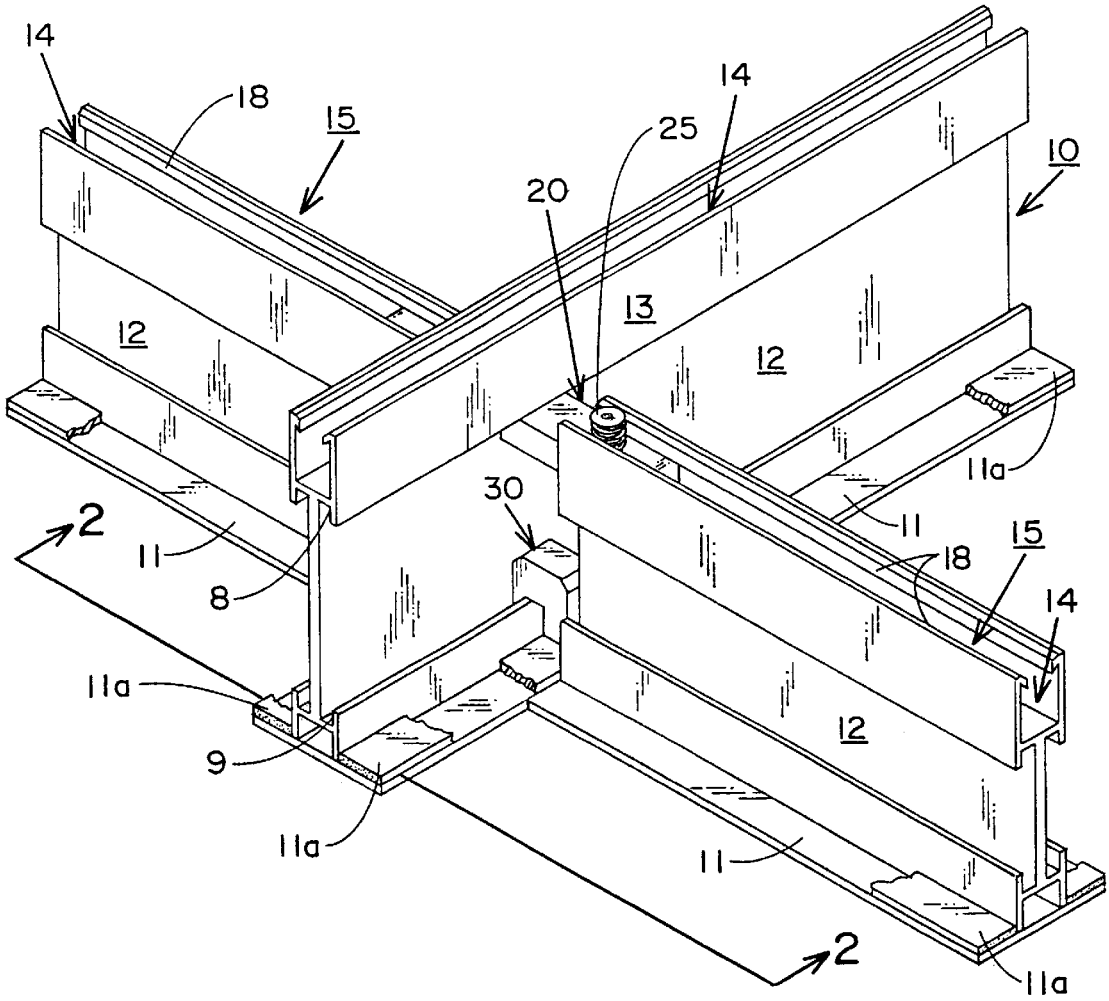
FIG. 1 is a perspective view of a runner and two cross members connected thereto by use of the present invention.
Figure 2:
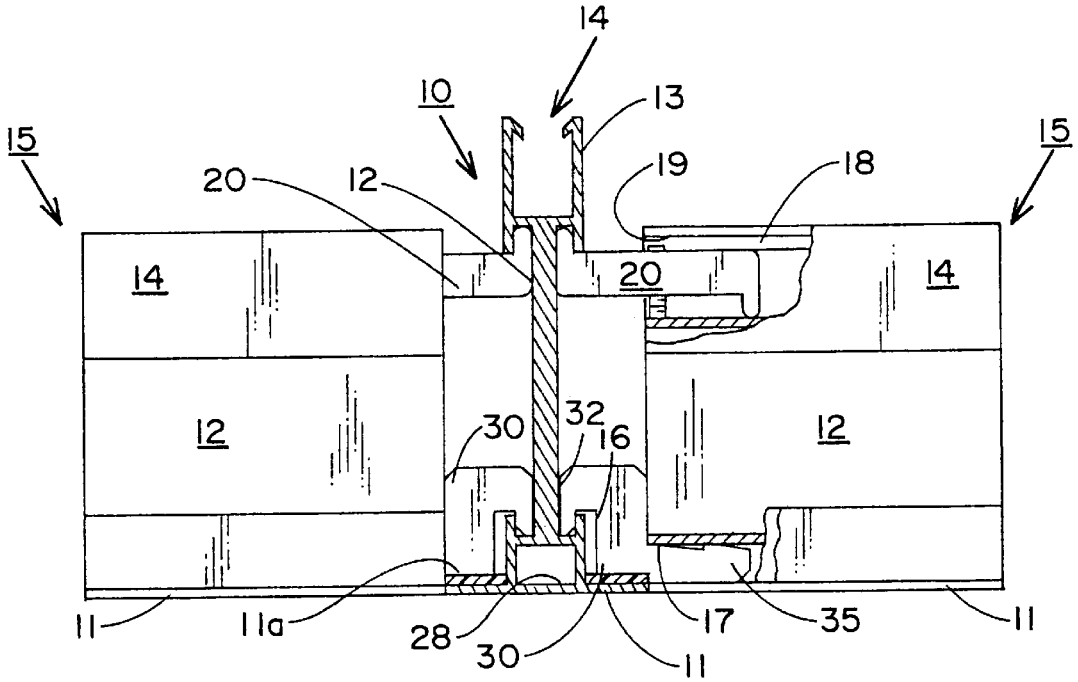
FIG. 2 is a cross-sectional view of the runner and connected cross members taken along lines 2—2 of FIG. 1.

Referring now to the drawings, there is illustrated in FIGS. 1 and 2 a portion of a grid-work for forming a suspended ceiling, or raised floor. Such a grid-work typically includes a runner 10, and connecting cross members 15, which are secured to and held in position relative to each other. Both the runners 10 and the cross members 15 typically include an outwardly extending lower flange 11 which is positioned at the lower portion of each of the cross members and runners for supporting a ceiling panel (not shown).

To form a sealed overhead structure of a ceiling, a seal 11*a* is included on the upper surface of the flanges 11. In this manner, when the grid-work is used to support ceiling panels for forming a suspended ceiling, an air-tight enclosure may be formed. When the grid-work is used for forming a raised flooring, a seal is not required as the function of a raised floor is to allow for the full cleanroom airflow from the cleanroom through the raised floor to the underside of such flooring which functions as a return air conduit or path back to the fans and/or HVAC system serving the cleanroom. Gasket type material may be used intermittently between the contact areas of the support flooring and the upper grid channels for the purpose of minimizing footfall noise, so long as such gasket material does not preclude air flow through the flooring panels.

Both the runners 10 and cross members 15 are formed with a vertically extending chord 12 which extends upwardly from the flanged lower portion thereof, and has an open and upwardly extending channel 14 at an upper end. The open channel 14 of the cross members 15 is used for securing the cross members 15 in a position substantially normal or perpendicular to the chord 12 of the runner 10. The open channel 14 formed on the runner 10 extends the longitudinal length thereof, and is used to connect the runner to a coupler (not shown) from which a suspended ceiling is suspended. When the grid-work is to be used for a raised floor, the channel 14 formed on the runner 10 is used to position a floor panel (not shown) which is also supported by the channels 14 on the cross members 15.

To enable the cross members 15 to be positioned at any location along the length of the runner 14, the cross members include an upper and a lower connector 20 and 30, respectively. The upper connector 20 is carried in the open channel 14 of the cross member 15 in a position to engage with an inner slot 8 formed between the chord 12 of the runner 10 and an inner surface of a side 13 from which the open runner channel 14 is formed. The lower connector 30 is press fit into an opening 17, best illustrated in FIGS. 5 and 6, formed in the cross member 15 between the lower flange 11 thereof and the vertically extending chord 12.

Figure 3:
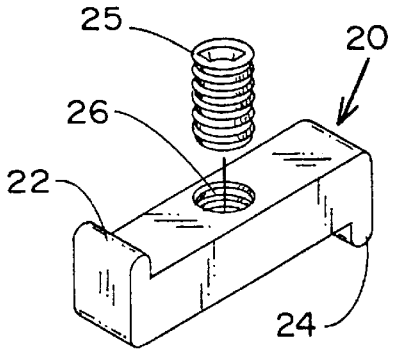
FIG. 3 is a perspective view of the upper connector used in the connecting system.

The upper connector 20 comprises a shaped block, best illustrated in FIG. 3, which is substantially rectangular in shape, and has a cross-section which conforms to that of the interior of the open channel 14 of the cross member 15 to permit the connector 20 to be positioned along the channel 14. The cross-sectional width of the connector 20 is sized to allow the connector 20 to be fit into the open. channel 14, but exceeds the distance between spaced inwardly turned lips 18 formed along the upper opening of the channels 14. In this manner, once the connector 20 has been inserted into the opening 19, best illustrated in FIGS. 5 and 6, which is formed at the end of the cross member channel 14, the connector 20 can not pass through the upper open top of the cross member channel 14.

The connector 20 is formed with a pair of symmetrically formed lips, 22 and 24, as best illustrated in FIG. 3. As illustrated, the upward turned lip 22 is formed on the upper surface of the connector 20 and the downwardly turned lip 24 is formed on the lower connector surface as illustrated in FIG. 3. In use, the symmetrical lips 22 and 24 so formed permit the connector to be inserted into the opening 19 without regard to the orientation of the connector lips. When the upper connector 20 is placed into the cross member channel 14 through the opening 19. A set screw 25 is threadingly engaged with a threaded hole 26 formed through the connector 20, and is tightened to secure the connector 20 in the desired position, and the connector is properly installed regardless of the orientation of the two lips 22 and 24.

Figure 5:
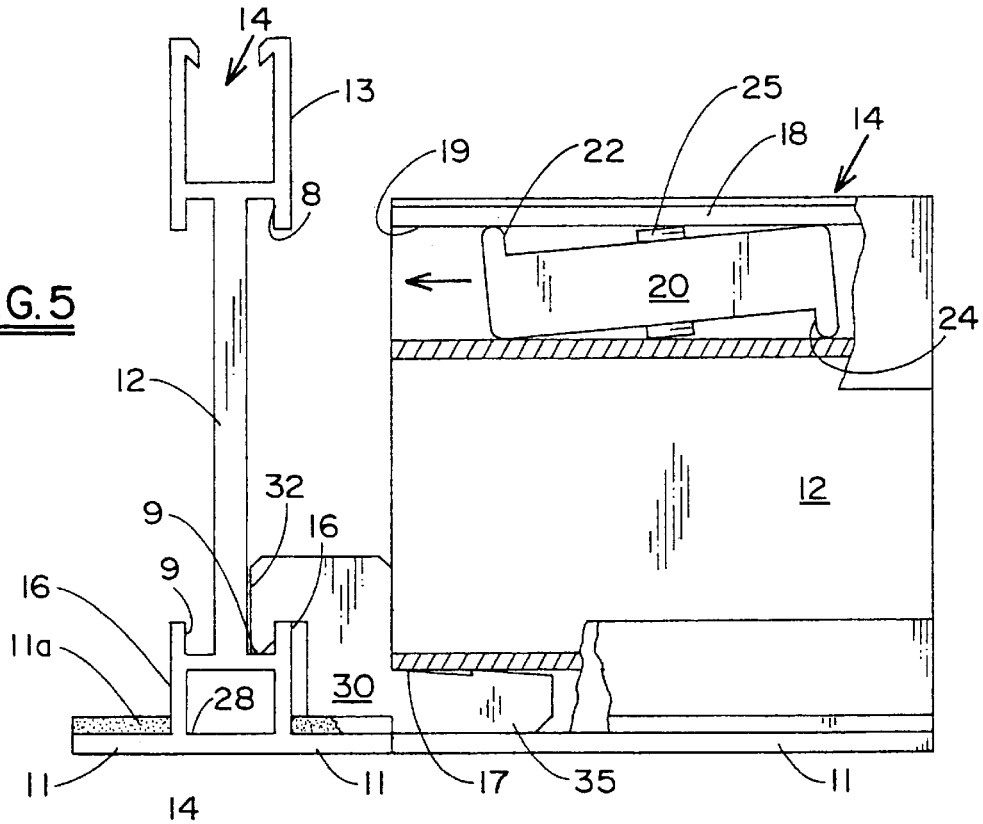
FIG. 5 is an elevational view of a portion of a cross member positioned with the lower connector engaged with a lower portion of a runner and the upper connector in a storage position within the upper portion of the cross member.
Figure 6:
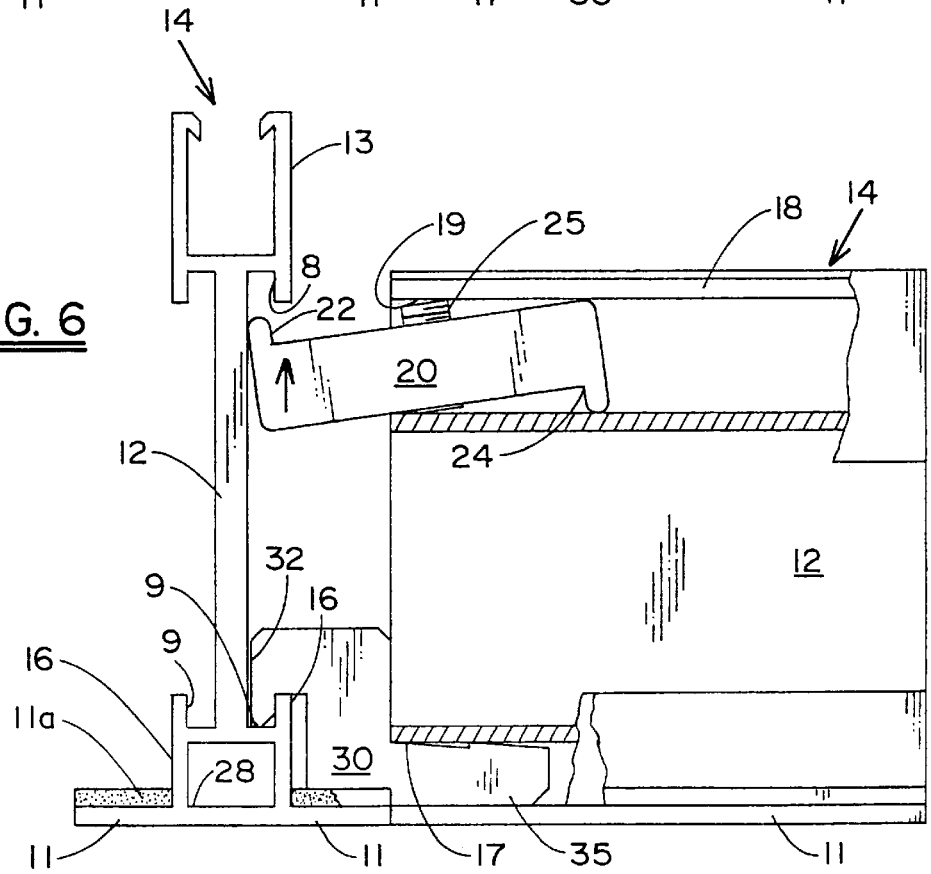
FIG. 6 is an elevational view of a portion of a cross member positioned with the, lower connector engaged with a lower portion of a runner and the upper connector positioned to engage the upper portion of the runner.

As best illustrated in FIGS. 5 and 6, the connector 20 can be positioned and secured within the open channel 14 in the manner illustrated in FIG. 5 for storage, and then be extended from the channel 14 through the opening 19 to engage the inner slot 8 when it is desired to couple the cross member 15 with a runner 10 as illustrated in FIG. 6.

When the set screw 25 is tightened, through the threaded hole 26, the connector 20 is forced into engagement with the bottom of the cross member channel 14 and the inwardly turned lips 18. In this manner the connector 20 can be stored inside the cross member channel 14 as shown in FIG. 5. When it is desired to install the cross member 15 onto the runner 10, the set screw 25 is loosened and the upper connector 20 extended out from the opening 19 and positioned to engage the runner 10 to lock the cross member 15 to the runner 10 at any desired position along the length thereof as illustrated in FIG. 6. The set screw 25 is then tightened after the upwardly turned lip 22 has been placed in engagement with the inner slot 8 at the desired location, thereby raising the upturned lip 22 into secured engagement with the runner 10 as illustrated in FIG. 2.

Figure 4:
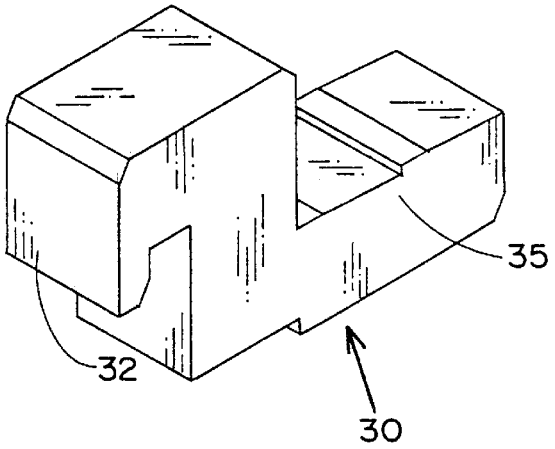
FIG. 4 is a perspective view of the lower connector used in the connecting system.

The lower connector 30, best illustrated in FIG. 4, is a stepped block having a downwardly turning lip 32 for engagement with an inner slot 9, formed between the chord 12 of the runner 10 and an inner surface of a vertically upward extending portion of a side wall 16 which forms in part a closed runner channel 28 between the lower end of the runner chord 12 and the runner flange 11, for securing the lower portion of the cross member 15 to the runner 10. The downwardly turned lip 32 is spaced from the adjacent side of the stepped block a sufficient distance, such as twice the thickness of the side wall 16, to facilitate rotational movement between the cross member 15 and the runner 10 when installing and removing cross members.

To secure the lower connector 30 into the opening 17 of the cross members 15, the lower connector 30 is formed with a stepped wedge-shaped portion 35 which is hydraulically press-fit into the opening 17. An anaerobic compound is applied to permanently secure the pressed wedge-shaped portion 35 into the opening 17 thereby providing additional chemical bonding.

Functional Description

When the connection system disclosed herein is to be installed for a raised floor or suspended ceiling grid-work, the cross members 15 are connected to the runners 10 to form the requisite grid-work upon which floor panels or ceiling panels are to be installed. The grid-work so formed by the interlocked runners 10 and cross members 15 has a bottom plane so formed from the mating parts that the bottoms of such components all lie flush in the same plane.

The upper connector 20 is maintained in its stored position as illustrated in FIG. 5, and the lower connector 30 is engaged with the runner 10. To this end, the downwardly turned lip 32 is positioned into the lower slot 9 of the runner 10 at the desired position along the longitudinal length of the runner.

The set screw 25, which is threadingly engaged with the upper connector 20, is loosened enabling the upper connector 20 to be moved along the upper open channel 14 of the cross member 15. The upper connector 20 is then positioned to extend outwardly through the opening 19 in the upper channel 14 of the cross member 15 to engage with the slot 8 formed adjacent the upper open channel 14 of the runner 10. When the upper connector 20 has been positioned into the slot 8 at the desired location, the set screw 25 is tightened to raise the upturned lip 22 into a fixed position. The upturned lip 22 is thereby locked into the slot 8, and the upper connector 20 is secured into the upper channel 14 of the cross member 15 completing the locking of the cross member 15 to the runner 10.

To remove the cross member 15 from the runner 10, or to re-position the cross member 15 to another position along the runner 10, this process is reversed. In this manner a cross member 15 can be installed anywhere along the longitudinal length of the runner 10, including being positioned to eliminate any edge gap between adjacent cross members 15 permitting such adjacent members to be butted against each other.

Other aspects and features of the present invention can be obtained from a study of the drawings, the disclosure, and the appended claims.

What is claimed is:

1. A connection system for connecting a freely positionable cross member along a runner for forming a grid-work upon which a suspended ceiling or a raised floor may be formed, comprising:

a grid-work forming runner having a first slot extending along a longitudinal length thereof and a first longitudinally extending channel adjacent thereto and upon which a floor forming panel may be supported;

a freely positionable grid-work forming cross member having a first longitudinally extending opening and an upper connector positionable therein to selectively engage said first slot of said grid-work forming runner along the longitudinal length thereof for connection thereto;

said upper connector having an upwardly turned lip for engagement with said first slot of said grid-work forming runner to be secured there into;

said grid-work forming runner having a second slot extending along the longitudinal length thereof and a second longitudinally extending channel positioned adjacent thereto and having a flange for supporting a ceiling forming panel;

said grid-work forming cross member having a second lower connector carried thereby to engage said second slot of said grid-work forming runner for connection thereto; and said lower connector having a downwardly turned lip for engagement with said second slot to be secured there into.

2. The connection system of claim 1 further including means for selectively securing said upper connector into and out from engagement with said first slot formed in said grid-work forming runner.

3. The connection system of claim 1 wherein said second lower connector is secured in an opening at an end portion of said grid-work forming cross member.

4. The connection system of claim 3 wherein said lower connector is formed with a symmetrical pair of lips with one lip extending downwardly and one lip extending upwardly to facilitate ease of orientation in said end portion of said grid-work forming cross member.

5. A suspended ceiling connection system for connecting a freely positionable cross member to a runner for forming a grid-work upon which a suspended ceiling may be supported, comprising:

a grid-work forming runner having a web portion and a first slot extending along a longitudinal length thereof adjacent said web portion;

said web portion including means for suspending said grid-work forming runner from an overhead support structure and means for supporting a suspended ceiling forming panel;

a freely positionable grid-work forming cross member having a first longitudinally extending opening and an upper connector positionable therein to selectively engage said first slot of said grid-work forming runner for connection thereto and said means for supporting a suspended ceiling forming panel;

said upper connector having an upwardly turned lip for engagement with said first slot of said grid-forming runner to be secured there into;

said freely positionable grid-work forming runner having a second slot extending along said longitudinal length thereof and positioned adjacent said web;

said freely positionable grid-work forming cross member also having a second lower connector carried in a position to engage said second slot of said grid-work forming runner for connection thereto; and said lower connector having a downwardly turned lip for engagement with said second slot of said grid-work forming runner to be secured there into.

6. The connection system of claim 5 wherein said grid-work forming runner and said means for supporting a suspended ceiling forming panel; ceiling panel to said grid-work forming runner and said grid-work forming cross member.

7. The suspended ceiling connection system of claim 5 further including means for selectively securing said upper connector into and out from engagement with said first slot formed in said grid-work forming runner.

8. The suspended ceiling connection system of claim 5 wherein said second lower connector is secured in an opening at an end portion of said grid-work forming cross member.

9. A raised floor connection system for connecting a cross member to a runner for forming a grid-work upon which a raised floor may be formed, comprising:

a grid-work forming runner having a web portion and a first slot extending along a longitudinal length thereof adjacent said web portion;

said web portion including means for supporting a floor panel thereon;

a freely positionable grid-work forming cross member having a first longitudinally extending opening and an upper connector positionable therein to selectively engage said first slot of said grid-work forming runner for connection thereto;

said upper connector having an upwardly turned lip for engagement with said first slot of said grid-forming runner to be secured there into;

said freely positionable grid-work forming runner having a second slot extending along said longitudinal length thereof and positioned adjacent said web;

said freely positionable grid-work forming cross member also having a second lower connector to engage said second slot of said grid-work forming runner for connection thereto; and said lower connector having a downwardly turned lip for engagement with said second slot of said grid-work forming runner to be secured there into.

10. The raised floor connection system of claim 9 wherein said grid-work forming cross member includes means for supporting a floor panel.

11. The raised floor connection system of claim 9 wherein said second lower connector is secured in an opening at an end portion of said grid-work forming cross member.

* * * * *

UNITED STATES PATENT AND TRADEMARK OFFICE

CERTIFICATE OF CORRECTION

PATENT NO. : 6,779,315 B1
APPLICATION NO. : 10/439208
DATED : August 24, 2004
INVENTOR(S) : Bongio et al.

It is certified that error appears in the above-identified patent and that said Letters Patent is hereby corrected as shown below:

Col. 5, claim 5, should read,

5. A suspended ceiling connection system for connecting a freely positionable cross member to a runner for forming a grid-work upon which a suspended ceiling may be supported, comprising:

a grid-work forming runner having a web portion and a first slot extending along a longitudinal length thereof adjacent said web portion;

said web portion including means for suspending said grid-work forming runner from an overhead support structure and means for supporting a suspended ceiling forming panel;

a freely positionable grid-work forming cross member having a first longitudinally extending opening and an upper connector positionable therein to selectively engage said first slot of said grid-work forming runner for connection thereto and said means for supporting a suspended ceiling forming panel;

said upper connector having an upwardly turned lip for engagement with said first slot of said grid-forming runner to be secured there into;

said freely positionable grid-work forming runner having a second slot extending along said longitudinal length thereof and positioned adjacent to said web --portion--;

said freely positionable grid-work forming cross member also having a second lower connector carried in a position to engage said second slot of said grid-work forming runner for connection thereto; and said lower connector having a downwardly turned lip engagement with said second slot of said grid-work forming runner to be secured there into.

UNITED STATES PATENT AND TRADEMARK OFFICE

CERTIFICATE OF CORRECTION

PATENT NO. : 6,779,315 B1
APPLICATION NO. : 10/439208
DATED : August 24, 2004
INVENTOR(S) : Bongio et al.

It is certified that error appears in the above-identified patent and that said Letters Patent is hereby corrected as shown below:

Col. 6, claim 6, lines 11-15, should read,

6. The connection system of Claim 5 wherein said grid-work forming runner and said means for supporting a suspended ceiling forming panel --include a seal for sealing a-- ceiling panel to said grid-work forming runner and said grid-work forming cross member.

Signed and Sealed this

Fourteenth Day of November, 2006

JON W. DUDAS
*Director of the United States Patent and Trademark Office*